US011718120B2

(12) United States Patent
Fukushima et al.

(10) Patent No.: US 11,718,120 B2
(45) Date of Patent: Aug. 8, 2023

(54) BINDING PROCESSING SYSTEM

(71) Applicant: Horizon International Inc., Takashima (JP)

(72) Inventors: Kazuyuki Fukushima, Takashima (JP); Tatsuaki Ida, Takashima (JP)

(73) Assignee: Horizon International, Inc., Takashima (JP)

( * ) Notice: Subject to any disclaimer, the term of this patent is extended or adjusted under 35 U.S.C. 154(b) by 0 days.

(21) Appl. No.: 17/417,630

(22) PCT Filed: Aug. 20, 2019

(86) PCT No.: PCT/JP2019/032448

§ 371 (c)(1),
(2) Date: Jun. 23, 2021

(87) PCT Pub. No.: WO2020/136985

PCT Pub. Date: Jul. 2, 2020

(65) Prior Publication Data

US 2022/0111675 A1 Apr. 14, 2022

(30) Foreign Application Priority Data

Dec. 27, 2018 (JP) ..... 2018-244515

(51) Int. Cl.
*B42C 99/00* (2006.01)
*B42C 19/00* (2006.01)
(Continued)

(52) U.S. Cl.
CPC ..... *B42C 99/00* (2013.01); *B26D 7/32* (2013.01); *B42C 19/00* (2013.01); *B42C 19/08* (2013.01);
(Continued)

(58) Field of Classification Search
CPC ..... B42C 19/00; B42C 19/08; B42C 99/00; F21V 7/0008
(Continued)

(56) References Cited

U.S. PATENT DOCUMENTS 6,712,492 B2 3/2004 Shimura et al.
7,812,853 B2 10/2010 Altenbach
(Continued)

FOREIGN PATENT DOCUMENTS

CN 206331118 U 7/2017
EP 2 886 352 A1 6/2015
(Continued)

OTHER PUBLICATIONS

Extended European Search Report for European Application No. 19903991.8 dated Aug. 25, 2022.
(Continued)

*Primary Examiner* — Kyle R Grabowski
(74) *Attorney, Agent, or Firm* — Muncy, Geissler, Olds & Lowe, P.C.

(57) ABSTRACT

Processing units 4 to 6 aligned along the transport path for a sheet bundle S are accommodated in a housing together with transport units 2 and 3. Windows 10*a* to 10*c* are provided in the housing front face, and variable-color lighting units 17 are arranged inside the housing. Light emitting surfaces (projection plates 18) of the variable-color lighting units are arranged facing the windows. Sensor units 13, 15*a*, and 15*b* that detect an anomaly of an operation of the transport unit and sensor units 14 and 16 that detect an anomaly of the operation of respective processing units are provided. A binding processing unit stops when an anomaly is detected by the sensor unit, when a system error occurs, or when an emergency stop instruction is input. The color of emission light from a light emitting surface changes to indicate the operation status of the binding processing system.

6 Claims, 6 Drawing Sheets

(51) Int. Cl.

| | |
|---|---|
| ***B42C 19/08*** | (2006.01) |
| ***B26D 7/32*** | (2006.01) |
| ***F21V 7/00*** | (2006.01) |
| *B26D 7/00* | (2006.01) |
| *H05B 45/20* | (2020.01) |
| *H05B 47/10* | (2020.01) |

(52) U.S. Cl.
CPC .... *F21V 7/0008* (2013.01); *B26D 2007/0081* (2013.01); *B26D 2007/322* (2013.01); *H05B 45/20* (2020.01); *H05B 47/10* (2020.01)

(58) Field of Classification Search
USPC ..... 412/11, 14
See application file for complete search history.

(56) References Cited

U.S. PATENT DOCUMENTS

| | | | | |
|---|---|---|---|---|
| 9,939,762 | B2 | 4/2018 | Kakitani et al. | |
| 2009/0129892 | A1* | 5/2009 | Okada | B42B 5/103 412/11 |
| 2017/0341888 | A1* | 11/2017 | Kache | B65H 5/006 |

FOREIGN PATENT DOCUMENTS

| | | | |
|---|---|---|---|
| JP | H 02-69654 | U | 5/1990 |
| JP | H0592844 | A | 4/1993 |
| JP | H05338861 | A | 12/1993 |
| JP | H 11-334243 | A | 12/1999 |
| JP | 2002298628 | A | 10/2002 |
| JP | 2004-085887 | A | 3/2004 |
| JP | 2006-79023 | A | 3/2006 |
| JP | 2008-093890 | A | 4/2008 |
| JP | 2008183902 | A | 8/2008 |
| JP | 5002856 | B2 | 8/2012 |
| JP | 2015-172810 | A | 10/2015 |
| JP | 2016-069151 | A | 5/2016 |
| JP | 2017142478 | A | 8/2017 |
| JP | 2018-171878 | A | 11/2018 |

OTHER PUBLICATIONS

Japanese Office Action dated Mar. 9, 2023 in corresponding application No. 2020-562339.

* cited by examiner

BINDING PROCESSING SYSTEM

CROSS-REFERENCE TO FOREIGN PRIORITY APPLICATIONS

This nonprovisional application is a National Stage of International Application No. PCT/JP2019/032448, which was filed on Aug. 20, 2019, and which claims priority to Japanese Patent Application No. 2018-244515, which was filed in Japan on Dec. 27, 2018, and which are both herein incorporated by reference.

TECHNICAL FIELD

The present invention relates to a binding processing system of a binder such as a perfect binder or a saddle stitcher, a three-knife trimmer, and the like.

BACKGROUND ART

As conventional binding processing systems, some binding processing systems include a plurality of processing units (a milling unit, a pasting unit, a nipping unit, a case feeding unit, and the like) aligned in series along a transport path of a bundle of simple leaf sheets (book block), a transport unit that transports the book block along the transport path, a housing that accommodates all the processing units and the transport unit, and a control unit that controls the transport unit and the processing units. Doors for access to the processing units are provided in the front face of the housing at positions corresponding to the respective processing units, windows for observation of the inside are provided in respective doors, and a lighting unit is further arranged inside the housing (for example, see PTL 1).

Further, in this type of binding processing systems, a sensor unit that detects an anomaly of an operation is arranged for each processing unit, and when the sensor unit detects an anomaly, an alarm is caused to sound, the binding processing system stops, and the type and the part of the processing unit in which the anomaly has occurred, a cause of the anomaly, and the like are displayed on a display of an operation panel (for example, see PTL 2).

Further, when the alarm sounds and the binding processing system stops during an operation of the binding processing system, an operator opens the door at the position of the processing unit in which the anomaly has occurred and performs recovery work on the abnormal part based on information displayed on the display of the operation panel.

According to such a configuration, however, the operator is unable to recognize the anomaly occurring status (the type and the part of the processing unit in which the anomaly has occurred, the cause of the anomaly, and the like) before viewing the display.

Thus, when the alarm sounds and the binding processing system stops, the operator is able to perform recovery work on the abnormal processing unit only after accessing the operation panel and confirming the anomaly occurring status, and as a result, there is a problem of delay of a countermeasure taken by the operator. This is particularly noticeable in a binding processing system in which a large number of processing units are arranged along a long transport line.

Furthermore, since display is provided in a limited area such as a display of the operation panel of the binding processing system, the visibility is not necessarily sufficient, and there is a problem of difficulty for the operator to recognize the anomaly occurring status.

CITATION LIST

Patent Literature

PTL 1

Japanese Patent No. 5002856

PTL 2

Japanese Patent Application Laid-Open No. H11-334243

SUMMARY OF INVENTION

Technical Problem

Therefore, the object of the present invention is to provide a binding processing system having an operation status indication function with superior visibility.

Solution to Problem

To achieve the object described above, according to the present invention, provided is a binding processing system including: a transport unit that transports a sheet bundle along a transport path; a plurality of processing units aligned along the transport path; and a housing that accommodates the plurality of processing units and the transport unit, and windows for observation of the inside are provided in a front face or a top face of the housing at positions corresponding to the plurality of processing units, respectively. The binding processing system further includes: a control unit that controls the transport unit and the plurality of processing units; a lighting unit arranged inside the housing; one or more first sensor units that are arranged in the transport unit and detect an anomaly of an operation of the transport unit; and one or more second sensor units that are arranged in the plurality of processing units, respectively, and each detect an anomaly of an operation of a related processing unit of the processing units. The binding processing system stops when the first or second sensor unit detects the anomaly, when a system error occurs in the control unit, or when an emergency stop instruction is input to the control unit, the lighting unit is formed of variable-color lighting units each arranged in corresponding one of the processing units, each of the variable-color lighting units has a light emitting surface arranged so as to face corresponding one of the windows, and an emission light color from each of the light emitting surfaces changes to indicate operation status of the binding processing system.

Herein, a "sheet bundle" includes not only a bundle of simple leaf sheets or fold sections (also referred to as a "book block") but also a simple leaf sheet and a single fold section or a book block or the like provided with a case (the same applies below).

Further, "light emitting surface(s) arranged so as to face the window(s)" means that the position and the angle relative to a window of a light emitting surface are set such that, when an operator looks into inside of a housing through the window from a normal standing position during a system operation, the operator can view at least a part of the light emitting surface (the same applies below).

According to a preferred embodiment of the present invention, the light emitting surfaces of all the variable-color lighting units emit light of a preset first color when the binding processing system is in a normal operation, and any of the light emitting surfaces of the variable-color lighting units of the related processing unit emits light of a preset second color different from the first color or turns on and off light of the second color when the second sensor unit detects the anomaly.

According to another preferred embodiment of the present invention, when the first sensor unit detects the anomaly, the light emitting surfaces of all the variable-color lighting units emit light of the second color, turn on and off light of the second color, emit light of a preset third color different from the first and second colors, or turn on and off light of the third color.

According to yet another preferred embodiment of the present invention, when the system error occurs or when the emergency stop instruction is input, the light emitting surfaces of all the variable-color lighting units emit light of the second color, turn on and off light of the second color, emit light of the third color, turn on and off light of the third color, emit light of a preset fourth color different from the first to third colors, or turn on and off light of the fourth color.

According to yet another preferred embodiment of the present invention, doors for access to the processing unit are provided at positions corresponding to the plurality of processing units of the housing, respectively, and when any of the doors of the housing is opened, the light emitting surface of a related variable-color lighting unit of the variable-color lighting units emits white light.

According to yet another preferred embodiment of the present invention, when the anomaly is detected by the first or the second sensor units, when the system error occurs in the control unit, or when the emergency stop instruction is input to the control unit, a character string indicating the anomaly, the system error, or the input of the emergency stop instruction is displayed on the light emitting surfaces of the variable-color lighting units with a color different from a color of emission light from the light emitting surfaces.

According to yet another preferred embodiment of the present invention, each of the variable-color lighting units includes a projection plate having a lusterless diffusion reflecting surface, and a light source that has one or more RGB LEDs and emits light to the diffusion reflecting surface of the projection plate, and the diffusion reflecting surface of the projection plate forms the light emitting surface.

According to yet another preferred embodiment of the present invention, the diffusion reflecting surface of the projection plate of each of the variable-color lighting units has a rectangular shape extending along the transport path.

Advantageous Effects of Invention

According to the present invention, the variable-color lighting units are arranged inside the housing of the binding processing system, each variable-color lighting unit is provided with a function of internal lighting and a function of an indicator lamp that indicates the driving status of the binding processing system, and the color of lighting is changed to indicate the operation status of the binding processing system (the operation status of the transport unit or the processing unit, the overall binding processing system, or a combination of two or more of the above).

Furthermore, the light emitting surface of the variable-color lighting unit is arranged facing the window to enable the operator to view the light emitting surface of the variable-color lighting unit through the window of the housing without difficulty.

Accordingly, the operator can intuitively recognize the operation status of the binding processing system on the spot without moving to the operation panel by simply viewing a change of color of the internal lighting of the housing also including the light emitting surface.

As described above, according to the present invention, a binding processing system having an operation status indication function with better visibility than the conventional art can be provided.

DESCRIPTION OF EMBODIMENTS

The configuration of the present invention will be described below with reference to the attached drawings based on preferred embodiments.

Figure 1:
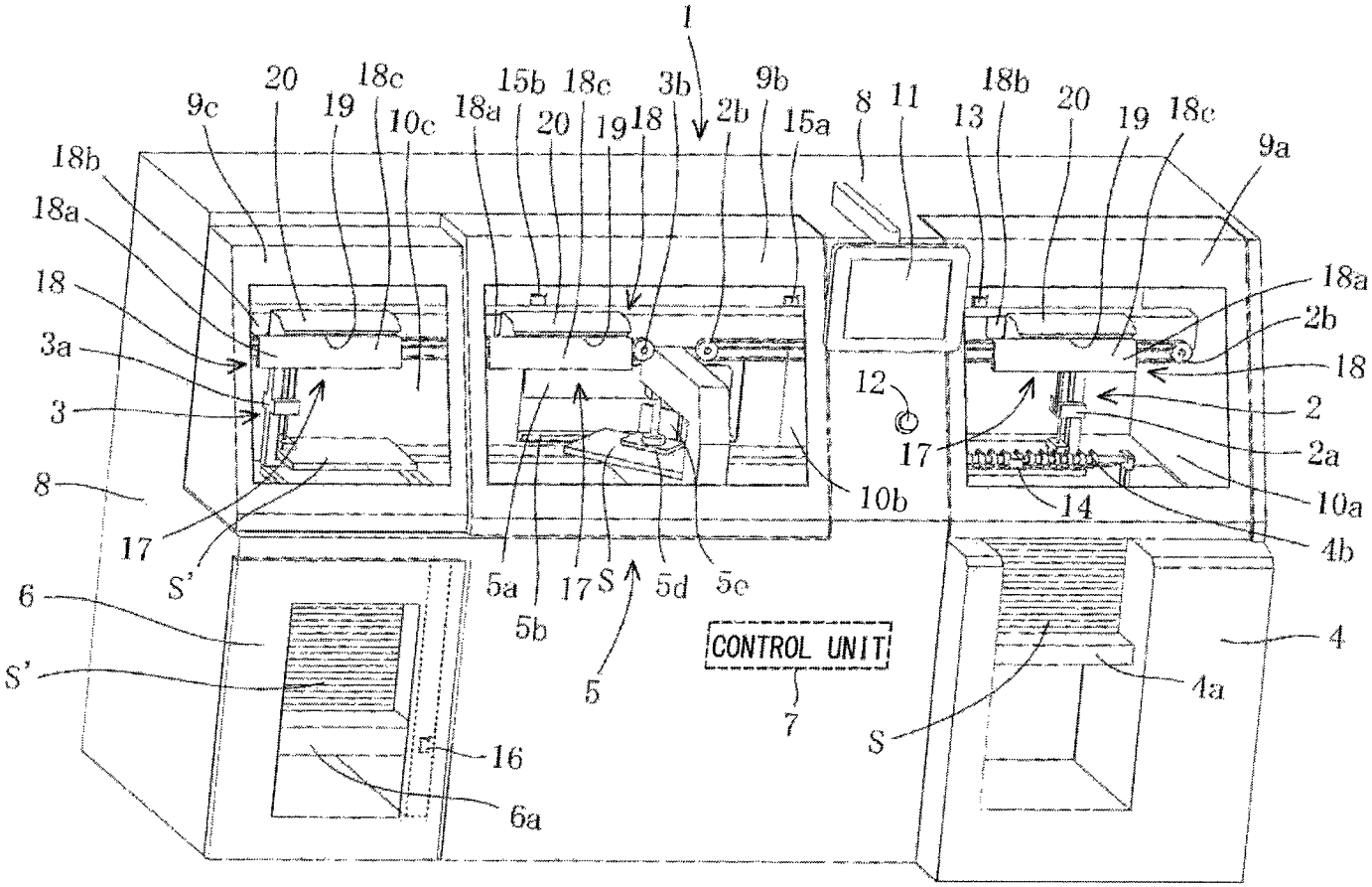
FIG. 1 is a perspective view of a binding processing system according to one embodiment of the present invention.
Figure 2:
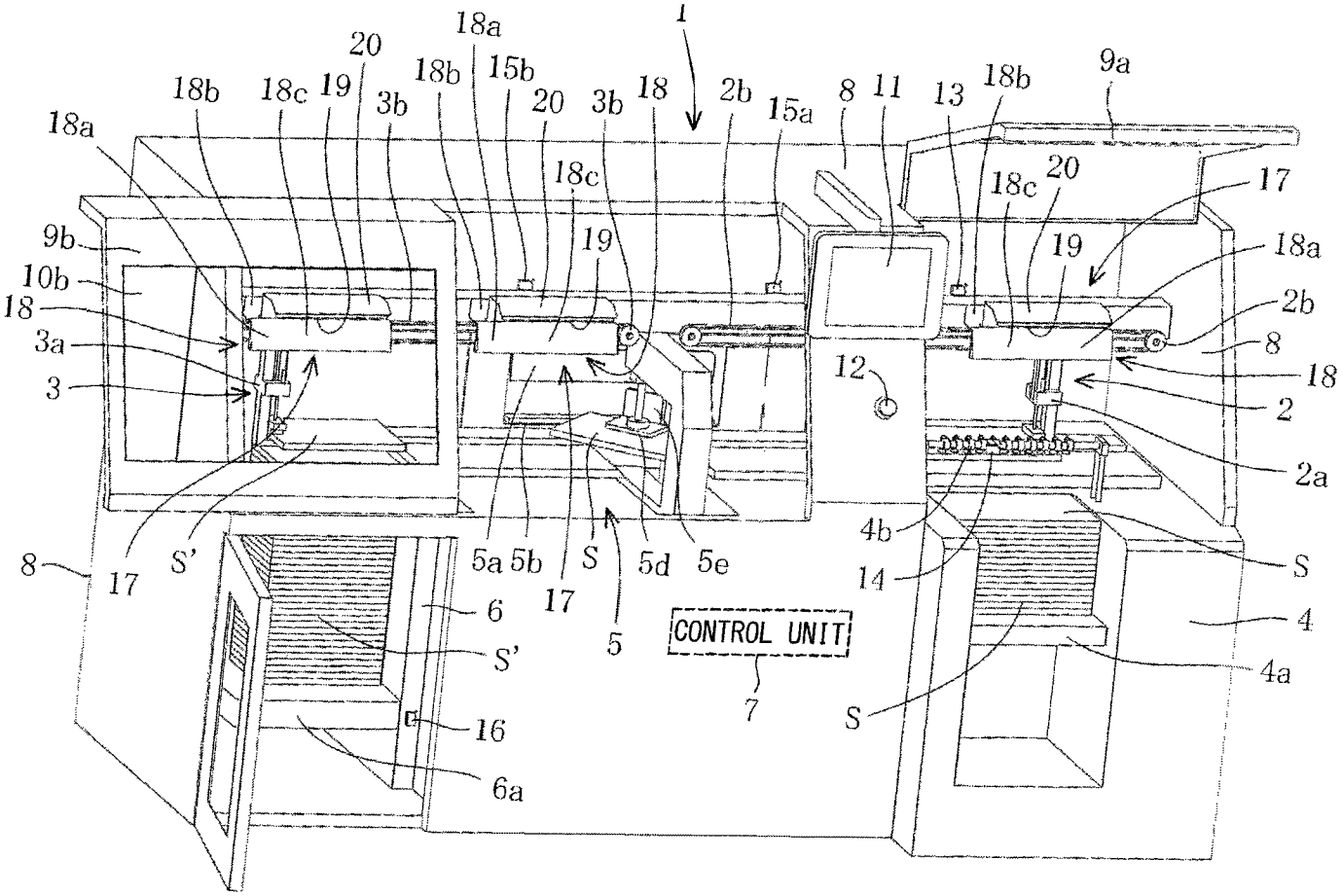
FIG. 2 is a perspective view illustrating a state where doors of a housing of the binding processing system of FIG. 1 are opened.

FIG. 1 is a perspective view of a binding processing system according to one embodiment of the present invention, and FIG. 2 is a perspective view illustrating a state where doors of a housing of the binding processing system of FIG. 1 are opened.

In this embodiment, the binding processing system is formed of a three-knife trimmer.

Referring to FIG. 1 and FIG. 2, a three-knife trimmer 1 has transport units 2 and 3 that transport a sheet bundle S along a transport path, a sheet feeding unit (first processing unit) 4, a trimming unit (second processing unit) 5, and an accumulation unit (third processing unit) 6 that are arranged in series along the transport path.

In the present embodiment, the sheet bundle S is formed of a book block to which a case has been attached.

In the present embodiment, the transport units 2 and 3 are formed of a first transport unit 2 that transports the sheet bundle S from the sheet feeding unit 4 to the trimming unit 5 and a second transport unit 3 that transports a sheet bundle S' trimmed by the trimming unit 5 to the accumulation unit 6.

The first transport unit 2 has a chuck head 2*a* that can grip the sheet bundle S, a guide (not illustrated) that extends from the sheet feeding unit 4 to the trimming unit 5 and to which the chuck head 2*a* is attached in a slidable manner, and a chuck head drive mechanism 2*b* that reciprocates the chuck head 2*a* along the guide.

The second transport unit 3 has a chuck head 3*a* that can grip the trimmed sheet bundle S', a guide (not illustrated) that extends from the trimming unit 5 to the accumulation unit 6 and to which the chuck head 3*a* is attached in a slidable manner, and a chuck head drive mechanism 3*b* that reciprocates the chuck head 3*a* along the guide.

The sheet feeding unit 4 includes a shelf 4*a* which is movable in the vertical direction and on which a stack of the sheet bundles S is placed, an elevating mechanism (not illustrated) that moves the shelf 4*a* up and down, and a sheet feeding mechanism 4*b* that sequentially feeds the uppermost sheet bundle S of the stack to the chuck head 2*a*.

The trimming unit 5 includes a cutting knife 5*a* movable in the vertical direction, a knife rest plate 5*b* arranged directly under and facing the cutting knife 5*a*, a rotation table 5*c*, a pressing plate 5*d* arranged above and opposed to the rotation table 5*c* and vertically movable, and an alignment plate 5*e* erected on one side of the rotation table 5*c*.

The accumulation unit 6 includes a shelf 6*a* on which the trimmed sheet bundles S' are accumulated and which is vertically movable and an elevating mechanism (not illustrated) that moves the shelf 6*a* up and down.

The transport units 2 and 3, the sheet feeding unit 4, the trimming unit 5, and the accumulation unit 6 are controlled by a control unit 7.

The three-knife trimmer 1 further includes a housing 8 that accommodates the sheet feeding unit 4, the trimming unit 5, and the accumulation unit 6 together with the transport units 2 and 3.

Further, doors 9*a* to 9*c* for access to the related units 4 to 6 are provided in the front face of the housing 8 at positions corresponding to the sheet feeding unit 4, the trimming unit 5, and the accumulation unit 6, respectively, and windows 10*a* to 10*c* for observation of the inside are provided in the doors 9*a* to 9*c*.

In the present embodiment, the door 9*a* of the sheet feeding unit 4 is attached rotatably about a horizontal axis extending in the lateral direction of the housing 8 on the upper edge, and the doors 9*b* and 9*c* of the trimming unit 5 and the accumulation unit 6 are attached to the housing 8 in nested arrangement so that each of the doors 9*b* and 9*c* can reciprocate and slide in the lateral direction.

Further, an operation panel 11 and an emergency stop button 12 are provided on the front face of the housing 8. When the emergency stop button 12 is pressed, an emergency stop instruction is input to the control unit 7.

A sensor unit (first sensor unit) 13 that detects passage of the chuck head 2*a* is arranged along the moving path of the chuck head 2*a* in the sheet feeding unit 4, and a sensor unit (second sensor unit) 14 that detects a sheet jam and wrong sheet feeding is arranged in the sheet feeding mechanism 4*b* of the sheet feeding unit 4.

Further, a sensor unit (first sensor unit) 15*a* that detects passage of the chuck head 2*a* is arranged along the moving path of the chuck head 2*a* in the trimming unit 5, and a sensor unit (first sensor unit) 15*b* that detects passage of the chuck head 3*a* is arranged along the moving path of the chuck head 3*a* in the trimming unit 5.

Furthermore, in the accumulation unit 6, a sensor unit (second sensor unit) 16 is arranged which detects a point of time the maximum number of sheet bundles S that can be accommodated by the accumulation unit 6 are accumulated on the shelf 6*a*.

The three-knife trimmer 1 operates as follows.

The sheet bundle S fed from the sheet feeding mechanism 4*b* of the sheet feeding unit 4 is gripped by the chuck head 2*a* and transported to the rotation table 5*c* of the trimming unit 5 by the chuck head 2*a*.

The shelf 4*a* rises by the thickness of a sheet bundle S every time a sheet bundle S is fed.

When one side of the sheet bundle S comes into contact with the alignment plate 5*e* and the sheet bundle S is placed at a predetermined position on the rotation table 5*c*, the pressing plate 5*d* moves down, the sheet bundle S is gripped between the rotation table 5*c* and the pressing plate 5*d*, and the chuck head 2*a* separates from the sheet bundle S and returns to the sheet feeding unit 4 in order to grip the next sheet bundle S.

Then, after the rotation table 5*c* moves forward to the cutting knife 5*a* while gripping the sheet bundle S between the rotation table 5*c* and the pressing plate 5*d* and rotates by 90 degrees, the tail edge of the sheet bundle S is then trimmed by the cutting knife 5*a*. Subsequently, the rotation table 5*c* rotates by 90 degrees, and the fore edge of the sheet bundle S is trimmed by the cutting knife 5*a*. Subsequently, the rotation table 5*c* rotates by 90 degrees, and the top edge of the sheet bundle S is trimmed by the cutting knife 5*a*.

In response to completion of the trimming process performed by the trimming unit 5, the chuck head 3*a* grips the trimmed sheet bundle S' on the rotation table 5*c*, the pressing plate 5*d* rises, and the trimmed sheet bundle S' is passed from the trimming unit 5 to the chuck head 3*a*. Then, the chuck head 3*a* moves toward the accumulation unit 6 while gripping the trimmed sheet bundle S', and releases and places the trimmed sheet bundle S' on the shelf 6*a* when reaching the above of the shelf 6*a* of the accumulation unit 6. Subsequently, the chuck head 3*a* moves toward the trimming unit 5 in order to grip the next trimmed sheet bundle S'.

The shelf 6*a* moves down by the thickness of the sheet bundle S every time the trimmed sheet bundle S' is placed on the shelf 6*a*.

Then, during the operation of the binding processing system, the three-knife trimmer 1 stops when the sensor unit (first sensor unit) 13, 15*a*, or 15*b* detects that the chuck head 2*a* has not passed, when the sensor unit (second sensor unit) 14 detects a sheet jam or wrong sheet feeding, when the sensor unit (second sensor unit) 16 detects that the accumulation unit 6 is full, when a system error occurs in the control unit 7, or when an emergency stop instruction is input to the control unit 7 via an emergency stop button 12.

Further, in the three-knife trimmer 1, variable-color lighting units 17 are arranged inside the housing 8 for respective processing units of the sheet feeding unit 4, the trimming unit 5, and the accumulation unit 6.

Figure 3B:
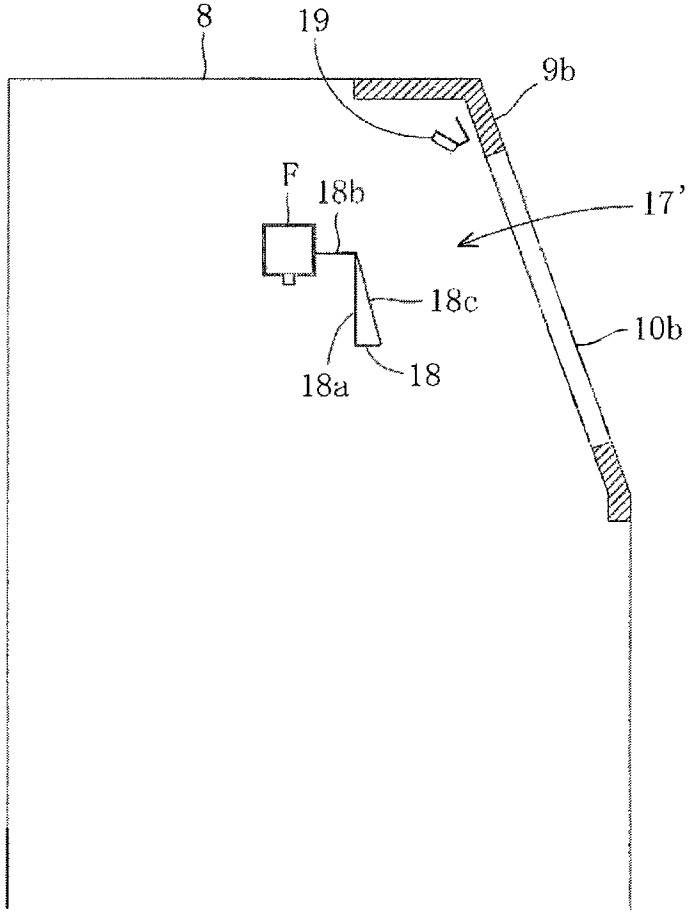
FIG. 3B is a side sectional view illustrating a modified example of the variable-color lighting unit of the binding processing system of FIG. 1.
Figure 3A:
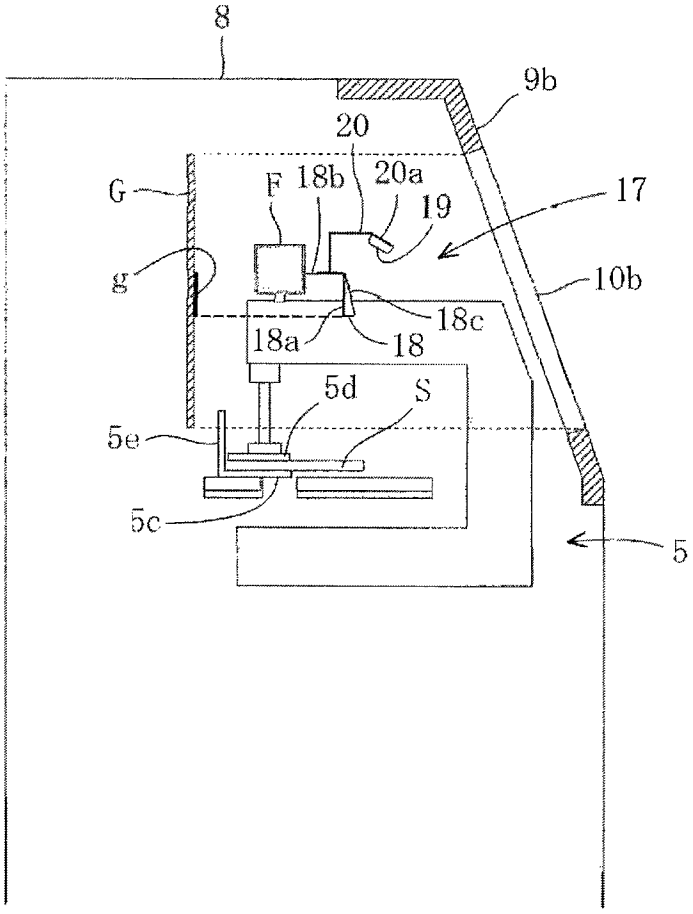
FIG. 3A is a side sectional view illustrating a configuration of a variable-color lighting unit of the binding processing system of FIG. 1.

FIG. 3A is a side sectional view illustrating a configuration of the variable-color lighting unit.

Referring to FIG. 1 to FIG. 3A, in the present embodiment, each variable-color lighting unit 17 includes a projection plate 18 having a lusterless diffusion reflecting surface 18*c* and a light source 19 having one or more RGB LEDs and configured to emit light to the diffusion reflecting surface 18*c* of the projection plate 18 and performs indirect lighting.

The projection plate 18 has a body 18*a* having an elongated hollow right-angled triangular prism shape and an attachment part 18*b* having an L-shaped cross section and extending from the side edge of one of the orthogonal sides of the body 18*a* at right angles relative to the one side and extending over the entire length of the side edge, and the inclined surface of the body 18*a* forms the diffusion reflecting surface 18*c*.

The projection plate 18 extends horizontally along the transport path and is attached to a frame F of the three-knife trimmer 1 in arrangement such that the diffusion reflecting surface 18*c* is inclined upward and faces corresponding one of the windows 10*a* to 10*c*.

Further, when looking into the inside of the housing 8 through the windows 10*a* to 10*c* from a normal position during a system operation, the operator is able to view at least a part of the diffusion reflecting surface 18*c* of the projection plate 18.

Note that, in the present embodiment, an orthogonal projection g of the diffusion reflecting surface 18*c* on a perpendicular plane obtained by a parallel projection method is located within a range of an orthogonal projection G of corresponding one of the windows 10*a* to 10*c* on the perpendicular plane obtained by a parallel projection method.

The light source 19 is formed of a line light source in which a plurality of RGB LEDs are aligned in a line and attached to the top face of the attachment part 18*b* of the projection plate 18 via a support member 20 with an inverted L-shaped cross section extending parallel to the projection plate 18.

In such a case, a tip portion 20*a* of the support member 20 is bent downward, and the light source 19 is attached to a back face of the tip portion 20*a* and emits light to the diffusion reflecting surface 18*c* from diagonally above the front of the diffusion reflecting surface 18*c* of the projection plate 18.

In such a way, since the variable-color lighting unit 17 is configured to perform indirect lighting and the light source 19 is not visible directly from the operator, advantageous effect that glare on the operator can be prevented and, in addition, design aesthetics of the three-knife trimmer 1 is improved can be obtained.

Note that any configuration can be employed as long as the variable-color lighting unit 17 has a projection plate having a lusterless diffusion reflecting surface and an RGB LED light source that emits light to the diffusion reflecting surface of the projection plate and performs indirect lighting.

Accordingly, as illustrated in FIG. 3B, for example, the light source 19 may be arranged at a position diagonally above the front of the diffusion reflecting surface 18*c* of the projection plate 18 and outside the sight through the windows 10*a* to 10*c*.

Figure 4B:
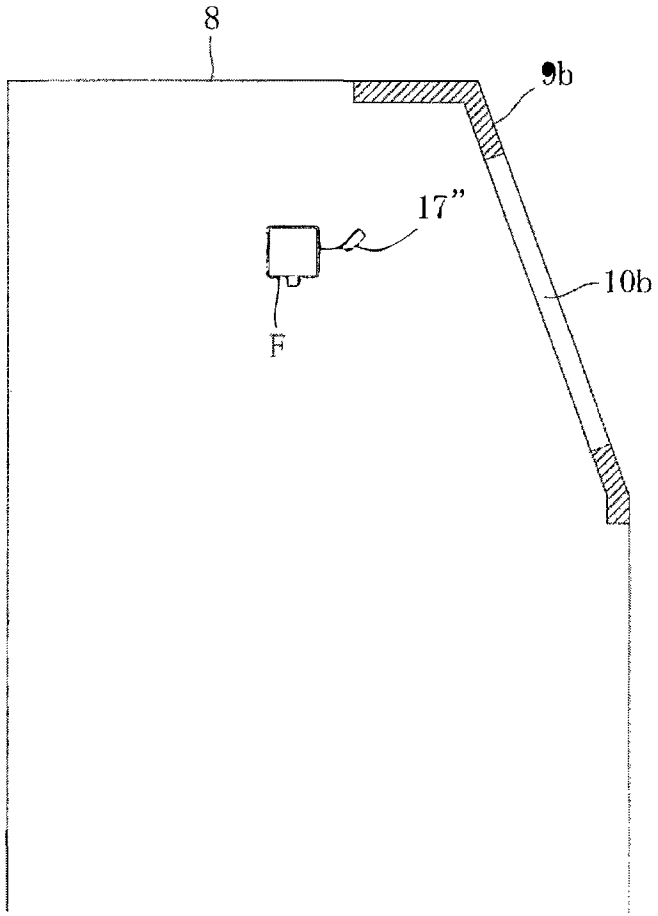
FIGS. 4A and 4B are diagrams similar to FIGS. 3A and 3B illustrating a modified example of the variable-color lighting unit.
Figure 4A:
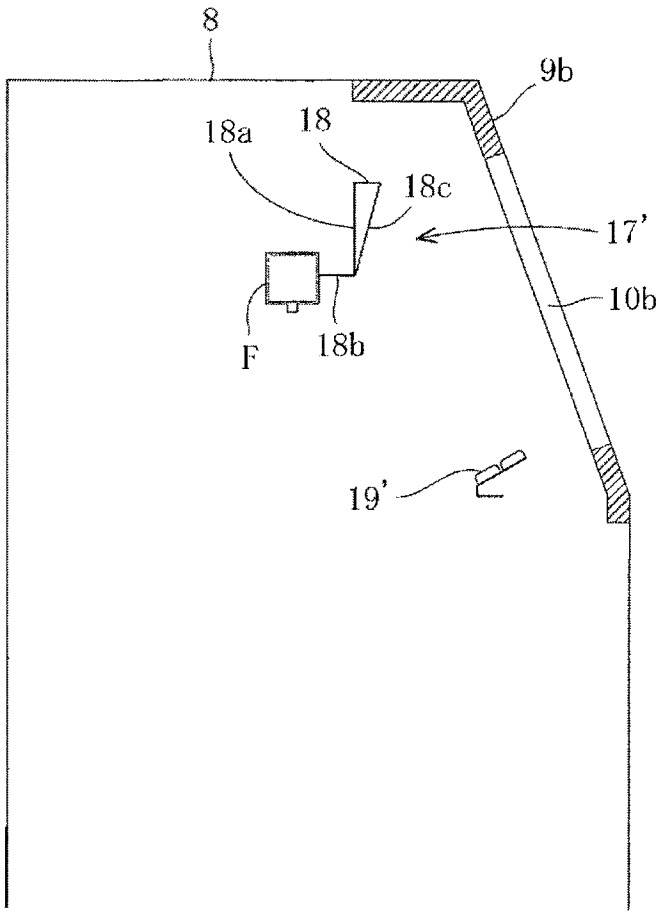

Alternatively, as illustrated in FIG. 4A, the variable-color lighting unit 17' can also be formed of the projection plate 18 extending horizontally along the transport path in arrangement such that the diffusion reflecting surface 18*c* is inclined downward and a light source 19' that is arranged diagonally below in front of the projection plate 18 and emits light to the diffusion reflecting surface 18*c*.

Furthermore, according to the present invention, the color of emission light from the light source 19 of the variable-color lighting unit 17, that is, the color of emission light from the projection plate 18 (diffusion reflecting surface 18*c*) is changed to indicate the operation status of the three-knife trimmer 1.

Although the projection plates 18 (diffusion reflecting surface 18*c*) of all the variable-color lighting units 17 emit light of a preset first color (for example, green) during a proper operation of the three-knife trimmer 1 in the present embodiment, when the sensor unit (second sensor unit) 14 or 16 detects an anomaly, the projection plate 18 (diffusion reflecting surface 18*c*) of the variable-color lighting unit 17 of the related processing unit 4, 5, or 6 emits light of a preset second color (for example, red) different from the first color (green) or turns on and off light of the second color (red).

Further, when the sensor unit (first sensor unit) 13, 15*a*, or 15*b* detects anomaly, the projection plates 18 (diffusion reflecting surfaces 18*c*) of all the variable-color lighting units 17 emit light of the second color (red) or turn on and off light of the second color (red).

In such a case, the projection plates 18 (diffusion reflecting surface 18*c*) may emit light of a different color from the first and second colors or turn on and off light of the different color.

Further, when a system error occurs or when the emergency stop button is pressed, the projection plates 18 (diffusion reflecting surfaces 18*c*) of all the variable-color lighting units 17 emit light of a preset third color (for example, orange) different from the first and second colors or turn on and off light of the third color.

In such a case, the projection plates 18 (diffusion reflecting surface 18*c*) may emit light of the second color (red) or turn on and off light of the second color (red).

Furthermore, in this embodiment, when any of the doors 9*a* to 9*c* of the housing 8 is opened, the related variable-color lighting unit 17 emits white light.

As described above, by irradiating the inside of the housing with white light, it is possible to perform recovery work on an abnormal part quickly and accurately.

According to the present invention, the variable-color lighting units 17 are arranged inside the housing 8 for the respective processing units 4 to 6 of the three-knife trimmer 1, each of the variable-color lighting units 17 is provided with a function of internal lighting and a function of an indicator lamp that indicates the driving status of the three-knife trimmer 1, and the color of the lighting is changed to indicate the operation status of the three-knife trimmer 1.

Furthermore, the projection plates 18 of the variable-color lighting units 17 are arranged on the opposite side of the windows 10*a* to 10*c* with respect to the transport path so as to face the windows 10*a* to 10*c* to enable the operator to view the projection plates 18 through the window of the housing 8 without difficulty.

Accordingly, the operator can intuitively recognize the operation status of the three-knife trimmer 1 on the spot without moving to the operation panel 11 by simply viewing a change of color of the internal lighting in the housing 8 also including the projection plates 18.

Figure 5:
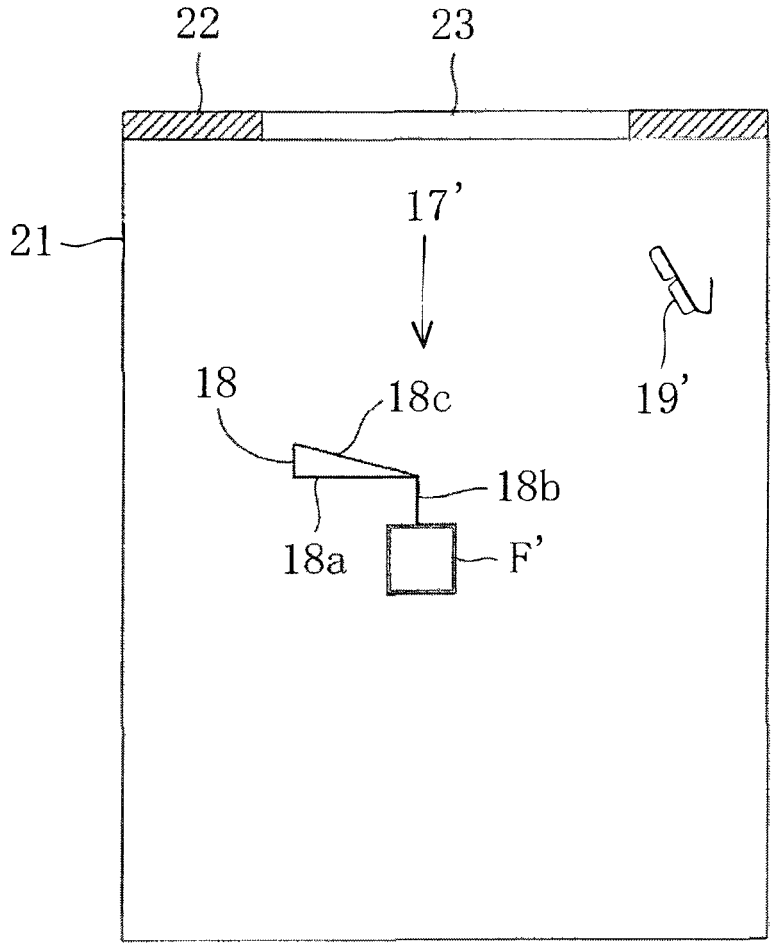
FIG. 5 is a diagram similar to FIG. 4A illustrating a variable-color lighting unit of a binding processing system according to another embodiment of the present invention.

FIG. 5 is a diagram similar to FIG. 4A illustrating a variable-color lighting unit of a binding processing system according to another embodiment of the present invention. Thus, in FIG. 5, the same components as those illustrated in FIG. 4A are labeled with the same numerals, and the detailed description thereof will be omitted below.

Referring to FIG. 5, in this embodiment, the housing 21 of the binding processing system has a rectangular side cross section, a door 22 is provided in the top face of the housing 21, and a window 23 for observation of the inside is provided in the door 22.

Further, a variable-color lighting unit 17' is arranged inside the housing 21.

The variable-color lighting unit 17' is formed of a projection plate 18, which extends horizontally along the transport path and is attached to a frame F' of the binding processing unit in arrangement such that the diffusion reflecting surface 18*c* is inclined upward and faces the window 23, and a light source 19', which is arranged diagonally above the projection plate 18 and emits light to the diffusion reflecting surface 18*c*.

Although the preferred embodiments of the present invention have been described above, the configuration of the present invention is not limited to the embodiments described above, and it is obvious that those skilled in the art may develop various modified examples within the scope of the claimed configuration of the present application.

For example, although the binding processing system is formed of a three-knife trimmer in the embodiments described above, the configuration of the transport unit forming the three-knife trimmer, the type and the number of processing units, the type and the number of sensor units (the type of an operation anomaly to be detected), and the like are not limited to those in the embodiments described above.

Further, the binding processing system is not limited to a three-knife trimmer and may be formed of a perfect binder or a saddle stitcher, for example.

Further, although the variable-color lighting unit is formed of a lighting unit that performs indirect lighting of variable colors in the embodiments described above, the variable-color lighting unit may be of any configuration as long as it has a light emitting surface and the light emitting surface is arranged so as to face a window on the opposite side of the window of the housing with respect to the transport path. Thus, as illustrated in FIG. 4B, a variable-color lighting unit 17" may be formed of a variable-color flat light source that performs direct lighting, for example.

Figure 6:
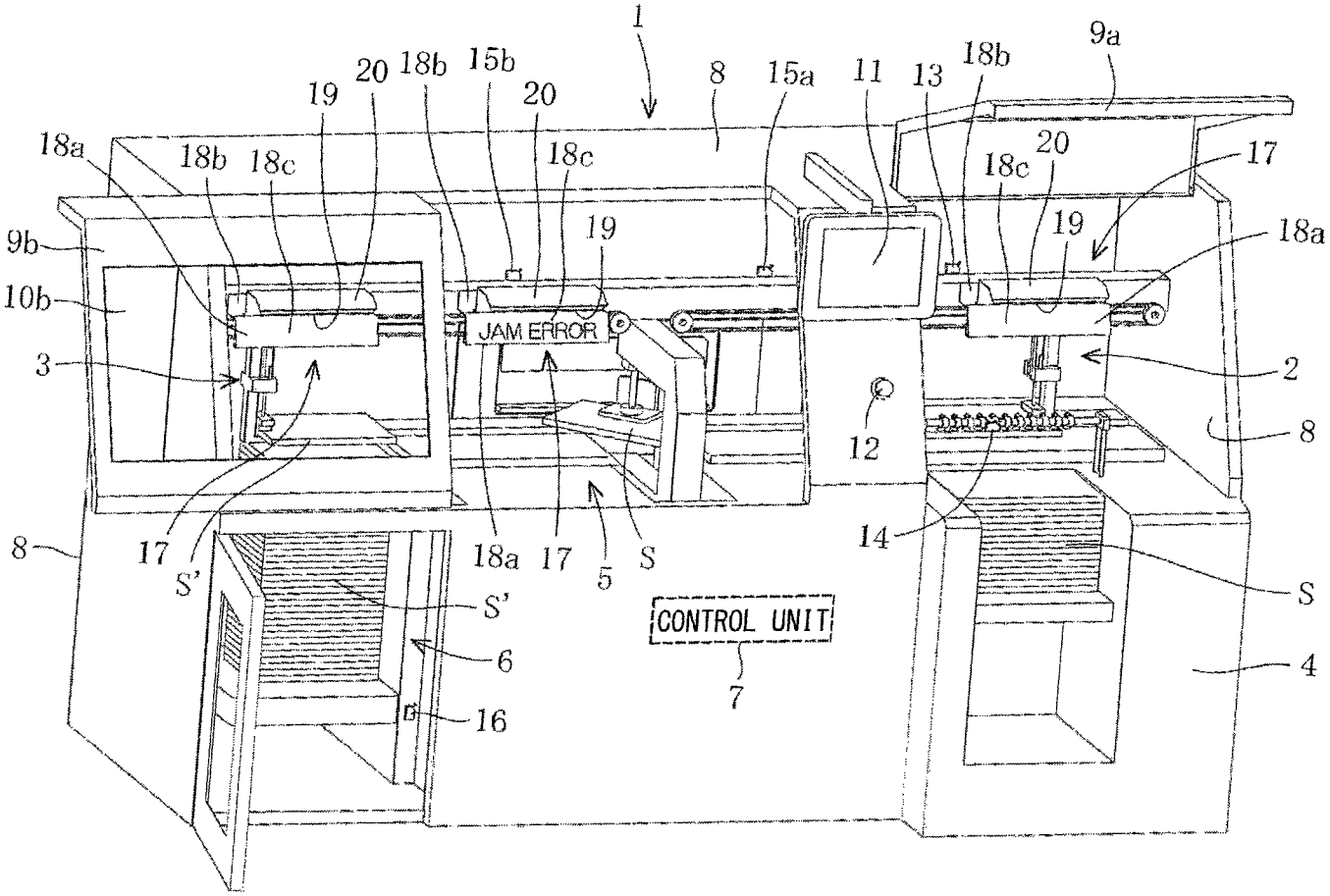
FIG. 6 is a diagram similar to FIG. 2 illustrating a binding processing system according to yet another embodiment of the present invention.

Further, for example, a configuration that displays a character string may be added to the embodiment of FIG. 1. Specifically, when an anomaly is detected by the first or second sensor unit 13 to 16, when a system error occurs in the control unit 7, or when an emergency stop instruction is input to the control unit 7, the configuration displays a character string representing the anomaly, the system error, or the input of the emergency stop instruction on the diffusion reflecting surface (light emitting surface) 18*c* of the variable-color lighting unit 17 by using a different color from a color of emission light from the diffusion reflecting surface 18*c* (see the text "JAM ERROR" on the diffusion reflecting surface 18*c* of the trimming unit 5 of FIG. 6).

Further, although the doors 9*a* to 9*c* are provided at positions corresponding to respective processing units 4 to 6 in the front face or the top face of the housing 8 and the windows 10*a* to 10*c* are provided in the doors 9*a* to 9*c* in the embodiments described above, the windows 10*a* to 10*c* are only required to be provided at positions corresponding to respective processing units in the front face or the top face of the housing 8 and are not necessarily required to be provided in the doors 9*a* to 9*c*.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A binding processing system comprising:

a transport unit that transports a sheet bundle along a transport path;

a plurality of processing units aligned along the transport path;

a housing that accommodates the plurality of processing units and the transport unit;

windows, for observation of inside, disposed in a front face or a top face of the housing at positions corresponding to the plurality of processing units, respectively;

a control unit that controls the transport unit and the plurality of processing units;

a lighting unit arranged inside the housing;

a plurality of first sensor units that are arranged in the transport unit and detect an anomaly of an operation of the transport unit; and a plurality of second sensor units that are arranged in the plurality of processing units, respectively, and each detect an anomaly of an operation of a related processing unit of the processing units, wherein the binding processing system stops when the first or second sensor unit detects the anomaly, when a system error occurs in the control unit, or when an emergency stop instruction is input to the control unit, wherein the lighting unit is formed of variable-color lighting units each arranged in corresponding one of the processing units, wherein each of the variable-color lighting units has a light emitting surface arranged so as to face corresponding one of the windows, wherein an emission light color from each of the light emitting surfaces changes to indicate operation status of the binding processing system, wherein the light emitting surfaces of all the variable-color lighting units are simultaneously configured to emit light of a preset first color when the binding processing system is in a normal operation, and any of the light emitting surfaces of the variable-color lighting units of the related processing unit is configured to emit light of a preset second color different from the first color or turns on and off light of the second color when the second sensor unit detects the anomaly of the operation of the related processing unit of the processing units, and wherein the light emitting surfaces of all the variable-color lighting units are configured to emit light of the second color, turn on and off light of the second color, emit light of a preset third color different from the first and second colors, or turn on and off light of the third color when one of the plurality of first sensor units detects the anomaly of the operation of the transport unit.

2. The binding processing system according to claim 1, wherein when the system error occurs or when the emergency stop instruction is input, the light emitting surfaces of all the variable-color lighting units emit light of the second color, turn on and off light of the second color, emit light of the third color, turn on and off light of the third color, emit light of a preset fourth color different from the first to third colors, or turn on and off light of the fourth color.

3. The binding processing system according to claim 2, wherein doors for access to the processing unit are provided at positions corresponding to the plurality of processing units of the housing, respectively, and when any of the doors of the housing is opened, the light emitting surface of a related variable-color lighting unit of the variable-color lighting units emits white light.

4. A binding processing system comprising:

a transport unit that transports a sheet bundle along a transport path;

a plurality of processing units aligned along the transport path;

a housing that accommodates the plurality of processing units and the transport unit;

windows, for observation of inside, disposed in a front face or a top face of the housing at positions corresponding to the plurality of processing units, respectively;

a control unit that controls the transport unit and the plurality of processing units;

a lighting unit arranged inside the housing;

one or more first sensor units that are arranged in the transport unit and detect an anomaly of an operation of the transport unit; and one or more second sensor units that are arranged in the plurality of processing units, respectively, and each detect an anomaly of an operation of a related processing unit of the processing units, wherein the binding processing system stops when the first or second sensor unit detects the anomaly, when a system error occurs in the control unit, or when an emergency stop instruction is input to the control unit, wherein the lighting unit is formed of variable-color lighting units each arranged in corresponding one of the processing units, wherein each of the variable-color lighting units has a light emitting surface arranged so as to face corresponding one of the windows, wherein an emission light color from each of the light emitting surfaces changes to indicate operation status of the binding processing system, and wherein when the anomaly is detected by the first or the second sensor units, when the system error occurs in the control unit, or when the emergency stop instruction is input to the control unit, a character string indicating the anomaly, the system error, or the input of the emergency stop instruction is displayed on the light emitting surfaces of the variable-color lighting units with a color different from a color of emission light from the light emitting surfaces.

5. A binding processing system comprising:

a transport unit that transports a sheet bundle along a transport path;

a plurality of processing units aligned along the transport path;

a housing that accommodates the plurality of processing units and the transport unit;

windows, for observation of inside, disposed in a front face or a top face of the housing at positions corresponding to the plurality of processing units, respectively;

a control unit that controls the transport unit and the plurality of processing units;

a lighting unit arranged inside the housing;

one or more first sensor units that are arranged in the transport unit and detect an anomaly of an operation of the transport unit; and one or more second sensor units that are arranged in the plurality of processing units, respectively, and each detect an anomaly of an operation of a related processing unit of the processing units, wherein the binding processing system stops when the first or second sensor unit detects the anomaly, when a system error occurs in the control unit, or when an emergency stop instruction is input to the control unit, wherein the lighting unit is formed of variable-color lighting units each arranged in corresponding one of the processing units, wherein each of the variable-color lighting units has a light emitting surface arranged so as to face corresponding one of the windows, wherein an emission light color from each of the light emitting surfaces changes to indicate operation status of the binding processing system, wherein each of the variable-color lighting units comprises:

a projection plate having a lusterless diffusion reflecting surface; and a light source that has one or more RGB LEDs and emits light to the diffusion reflecting surface of the projection plate, and wherein the diffusion reflecting surface of the projection plate forms the light emitting surface.

6. The binding processing system according to claim 5, wherein the diffusion reflecting surface of the projection plate of each of the variable-color lighting units has a rectangular shape extending along the transport path.

* * * * *